US007197267B2

(12) United States Patent
Hatakeyama et al.

(10) Patent No.: US 7,197,267 B2
(45) Date of Patent: Mar. 27, 2007

(54) IMAGE FORMING APPARATUS AND CONTROL METHOD USING A TWO-COMPONENT DEVELOPER

(75) Inventors: Takashi Hatakeyama, Yokohama (JP); Shoko Shimmura, Yokohama (JP); Toshihiro Kasai, Yokohama (JP); Minoru Yoshida, Machida (JP); Takeshi Watanabe, Yokohama (JP); Masashi Takahashi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 220 days.

(21) Appl. No.: 10/945,427

(22) Filed: Sep. 21, 2004

(65) Prior Publication Data

US 2006/0062602 A1 Mar. 23, 2006

(51) Int. Cl.
*G03G 15/08* (2006.01)

(52) U.S. Cl. ..... 399/254; 399/255; 399/256

(58) Field of Classification Search ..... 399/148, 399/149, 150, 222, 252, 253, 254, 255, 256
See application file for complete search history.

(56) References Cited

U.S. PATENT DOCUMENTS

| | | | | |
|---|---|---|---|---|
| 5,436,703 | A | 7/1995 | DeYoung et al. | |
| 6,151,471 | A * | 11/2000 | Yahata et al. | 399/258 |
| 6,615,014 | B2 * | 9/2003 | Sugihara | 399/254 |
| 7,039,344 | B2 * | 5/2006 | Nishiyama | 399/254 |
| 7,046,945 | B2 * | 5/2006 | Nishitani et al. | 399/254 |

FOREIGN PATENT DOCUMENTS

JP 2866319 B2 12/1998

* cited by examiner

*Primary Examiner*—Hoan Tran
(74) *Attorney, Agent, or Firm*—Foley & Lardner LLP

(57) ABSTRACT

A CPU controls a shutter of a developing device so as to enable movement of a developer between a first chamber and a second chamber that store the developer. The CPU rotates a developing roller and mixers of the first and second chambers for a predetermined time T, and stirs and conveys the developer. Thereby, the developer is moved from the first chamber into the second chamber. The amount of movement of the developer is understandable from the rotational speed and shape of each mixer. Hence, the amount of developer, which is moved from the first chamber to the second chamber, is estimated in advance, and about half the developer in the first chamber is replaced.

18 Claims, 13 Drawing Sheets

IMAGE FORMING APPARATUS AND CONTROL METHOD USING A TWO-COMPONENT DEVELOPER

BACKGROUND OF THE INVENTION

1. Field of the Invention

The present invention relates to an image forming apparatus that forms an image using a two-component developer, and a control method.

2. Description of the Related Art

In recent years, most of dry-type printers and copying machines have adopted a development system using a two-component developer that is composed of toner and carrier. While toner is consumed at the time of printing, carrier remains in a developing device. Consequently, the carrier is always stirred, and the carrier may be crushed or toner may adhere to the carrier. The carrier thus deteriorates, and the development performance is degraded.

In the case of a cleanerless photoconductor body, such a problem arises that paper dust enters the developing device. The paper dust, which has once entered the developing device, will never go out. If such paper dust accumulates in the developing device, an image defect occurs and, for example, image formation may be disabled.

If means (e.g. filter) for reclaiming the developer is provided within the developing device that has a developing roller, such means may hinder conveyance of the developer.

There is known a development method that is called "occasional small-amount developer replacement method." In this method, aside from consumed toner replenishment, new carrier (conc. toner: replenishing developer) is replenished into the developing device, and excess developer is let to overflow out of a discharge port that is formed in the wall of the developing device. Degraded developer is replaced with new toner and carrier, thereby maintaining the development performance and suppressing degradation in image quality.

In the occasional small-amount developer replacement method, however, the toner/carrier ratio is different between the developer within the developing device and the conc. toner (developer). Thus, the developer and conc. toner are not easily mixed, and non-uniformity tends to occur in the density of an output image. In addition, new developer tends to flow out of the discharge port.

BRIEF SUMMARY OF THE INVENTION

The object of an aspect of the present invention is to provide an image forming apparatus and a control method, which can prevent degradation in developer, can efficiently reduce developer degradation, and can stably perform good image formation.

According to an aspect of the present invention, there is provided an image forming apparatus that forms an image using a two-component developer, comprising: first storing means for storing the two-component developer; first stirring/conveying means for stirring/conveying the two-component developer that is stored in the first storing means; developing means for effecting development using the two-component developer that is stirred/conveyed by the first stirring/conveying means; second storing means for storing the two-component developer; second stirring/conveying means for stirring/conveying the two-component developer that is stored in the second storing means; and control means for controlling movement of the two-component developer that is stored in the first storing means and the second storing means, using the first and second stirring/conveying means.

According to another aspect of the present invention, there is provided a control method for an image forming apparatus that forms an image using a two-component developer, comprising: providing a first chamber that stores the two-component developer; providing a first mixer that stirs/conveys the two-component developer that is stored in the first chamber; providing a developing device that effects development using the two-component developer that is stirred/conveyed by the first mixer; providing a second chamber that stores the two-component developer; providing a second mixer that stirs/conveys the two-component developer that is stored in the second chamber; and controlling movement of the two-component developer that is stored in the first chamber and the second chamber, using the first and second mixers.

Additional objects and advantages of an aspect of the invention will be set forth in the description which follows, and in part will be obvious from the description, or may be learned by practice of the invention. The objects and advantages of an aspect of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of an aspect of the invention.

DETAILED DESCRIPTION OF THE INVENTION

An embodiment of the present invention will now be described with reference to the accompanying drawings.

Figure 1:
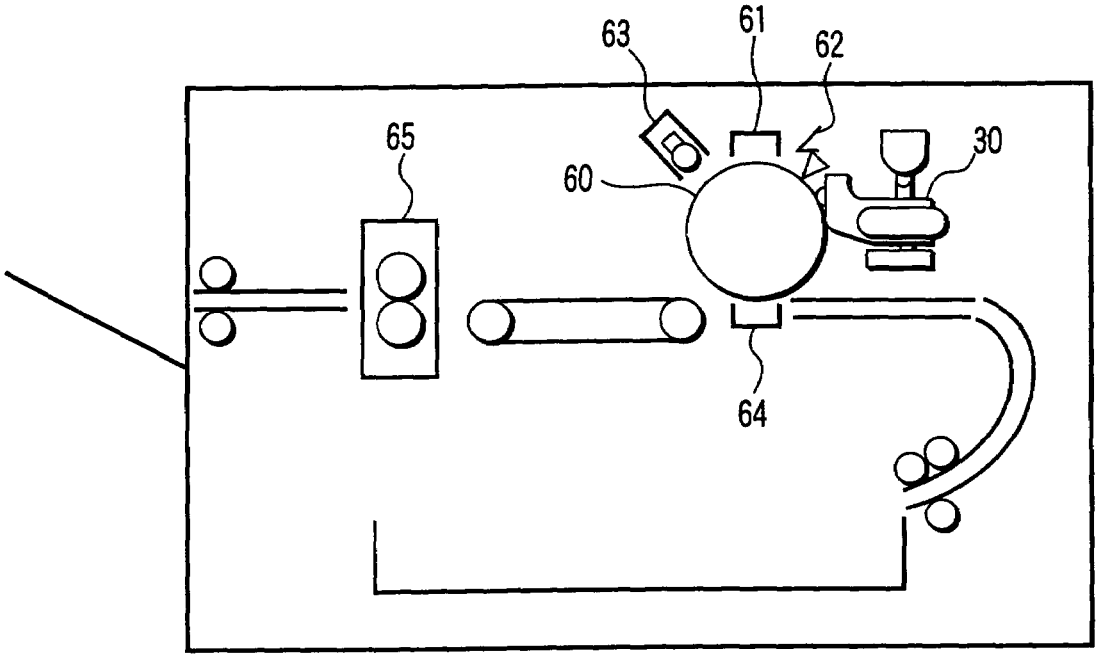
FIG. 1 is a cross-sectional view that schematically shows the structure of a copying machine relating to an image forming apparatus according to an embodiment of the present invention.

FIG. 1 schematically shows the structure of a copying machine relating to an image forming apparatus according to the embodiment of the present invention. The copying machine comprises a photoconductor body 60; a charging device 61 that charges the photoconductor body 60; an exposure device 62 that forms an electrostatic latent image on the photoconductor body 60; a developing device 30 that develops the electrostatic latent image on the photoconductor body 60; a charge erase device 63 that erases the charge on the surface of the photoconductor body 60; a transfer device 64 that transfers a toner image from the photoconductor body 60 to paper; and a fixing device 65 that fixes the toner on the paper.

Figure 2:
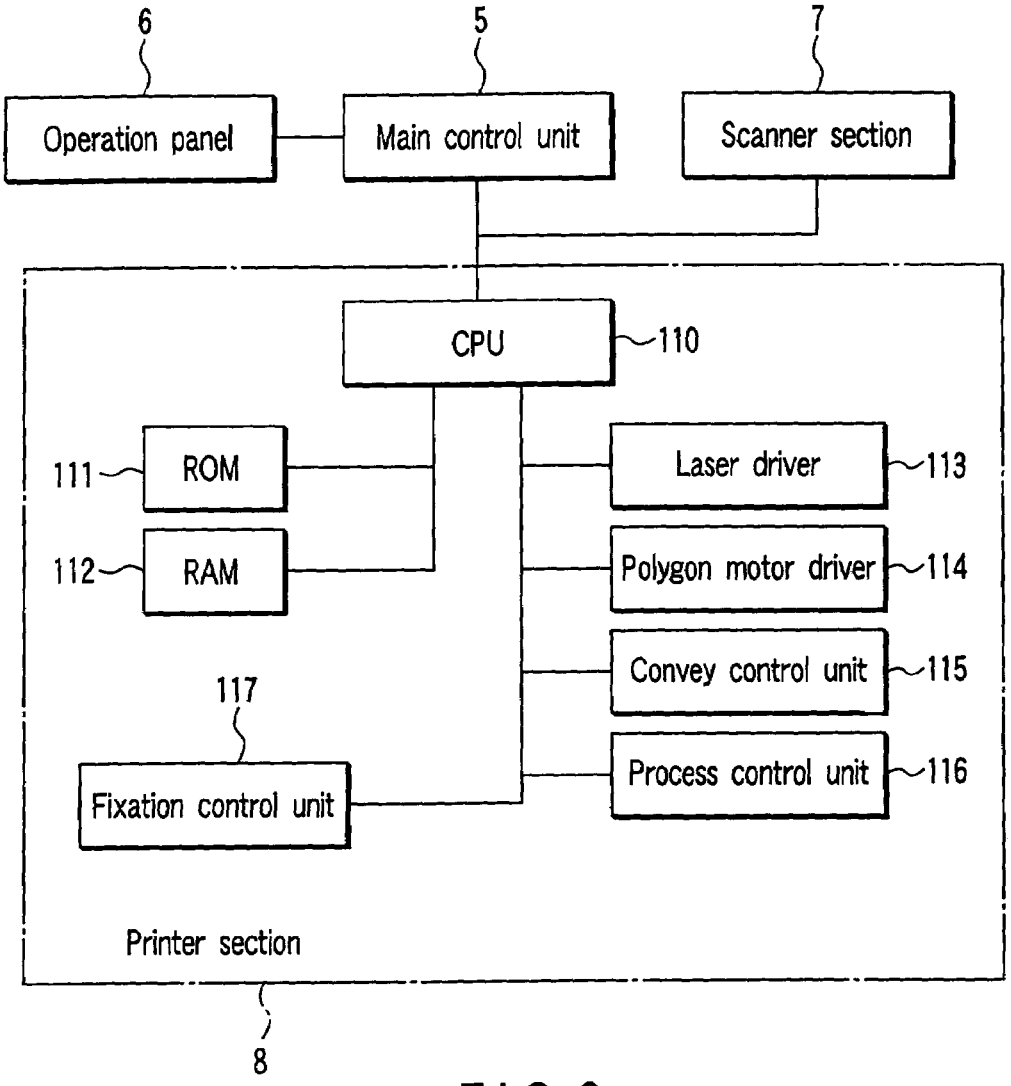
FIG. 2 is a block diagram that shows the structure of a control system of the copying machine.

FIG. 2 shows the structure of a control system of the copying machine. The copying machine comprises a main control unit 5 for executing an overall control, an operation panel 6 for executing various settings, a scanner section 7 serving as image reading means for reading an image on an original, and a color printer section 8 serving as image forming means for forming an image.

The printer section 8 comprises a CPU 110 for executing an overall control; a ROM 111 that stores a control program, etc.; a RAM 112 for storing data; a laser driver 113 that drives a semiconductor laser of a laser optical system (not shown); a polygon motor driver 114 that drives a polygon motor (not shown); a convey control unit 115 that controls conveyance of paper serving as a transfer medium; a process control unit 116 that controls processes of charging, development and transfer using the charging device 61, developing device 30 and transfer device 64; and a fixation control unit 117 that controls the fixing device.

Next, a first embodiment is described.

Figure 3:
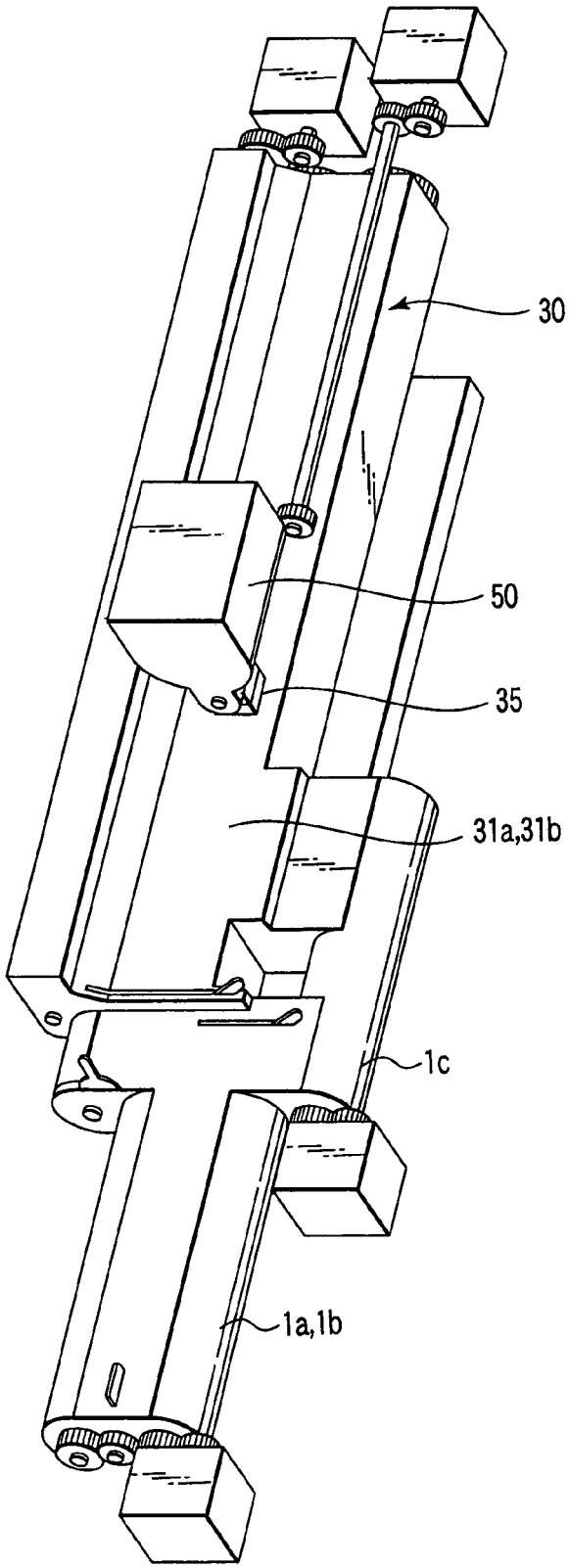
FIG. 3 schematically shows the structure of a developing device according to a first embodiment.

FIG. 3 schematically shows the structure of the developing device 30 according to the first embodiment. As will be described later in detail, the developing device 30 includes first chambers 31*a*, 31*b* and second chambers 1*a*, 1*b*, 1*c* for containing a developer. The developing device 30 also includes an inlet 35 on the first chamber 31*b*, as shown in FIG. 3. A hopper 50 is disposed above the inlet 35.

Figure 4:
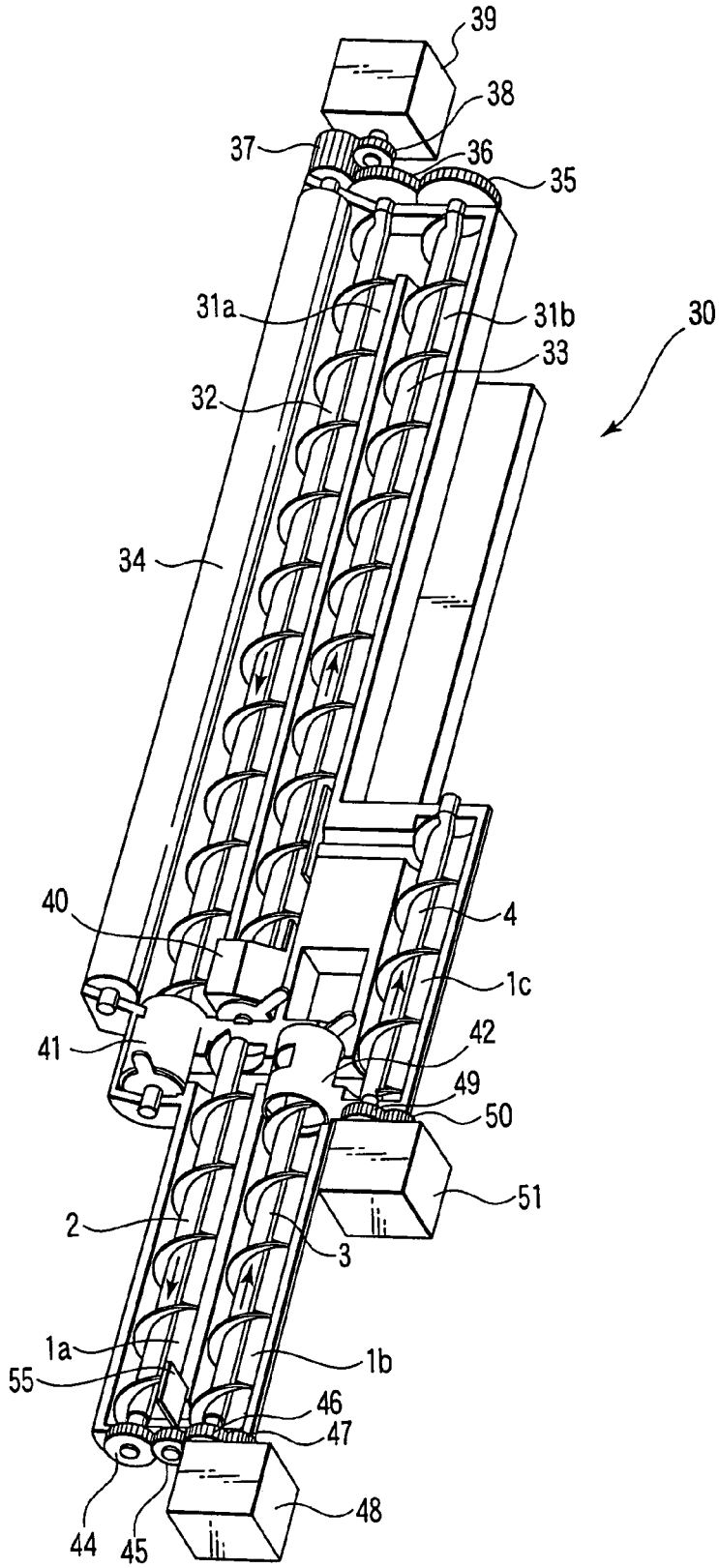
FIG. 4 is a perspective view of the developing device, with an upper part of the casing being removed to show the internal structure.

FIG. 4 is a perspective view of the developing device 30, with an upper part of the casing being removed to show the internal structure. The developing device 30 includes the first chambers 31*a*, 31*b* for containing developer, mixers 32 and 33 for stirring and conveying the developer, and a developing roller 34 for development. The direction of movement of the developer by the mixers 32 and 33 is indicated by arrows. The developing device 30 also includes a motor 39 and gears 35, 36, 37 and 38 for rotating the developing roller 34 and mixers 32 and 33.

The developing device 30 further includes the second chambers 1*a*, 1*b* and 1*c* for containing developer, and mixers 2, 3 and 4 for stirring and conveying the developer. The direction of movement of the developer by the mixers 2, 3 and 4 is indicated by arrows. The developing device 30 also includes a motor 48 and gears 44, 45, 46 and 47 for rotating the mixers 2 and 3. In addition, the developing device 30 is equipped with a motor 51 and gears 49 and 50 for rotating the mixer 4.

Shutters 40, 41 and 42 for controlling movement of developer are disposed between the first chambers 31*a*, 31*b* and the second chambers 1*a*, 1*b*, 1*c*.

A filter 55 is provided between the second chambers 1*a* and 1*b*, as will be described later in detail.

Figure 5:
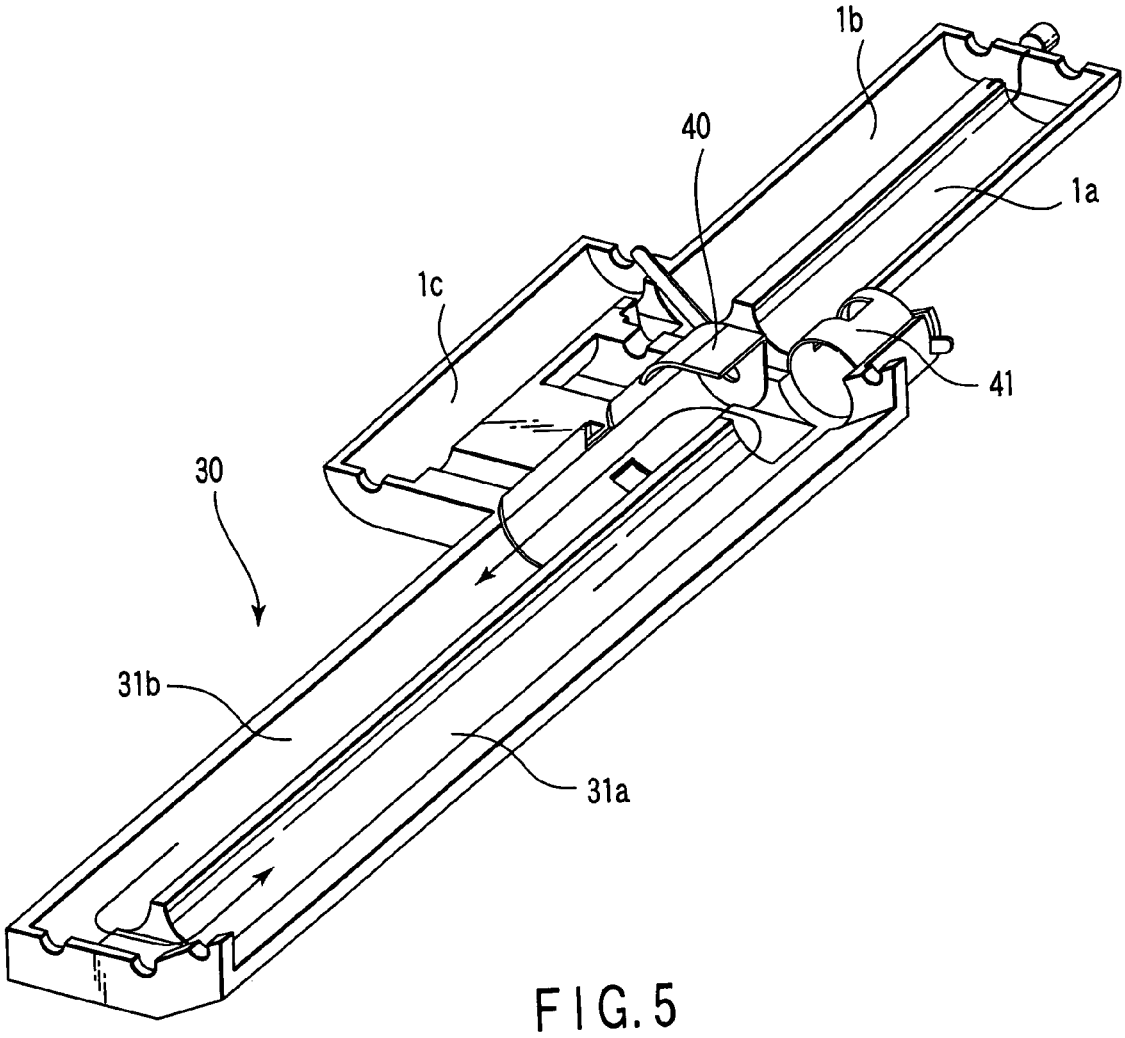
FIG. 5 is a view for explaining a shutter and the flow of developer.
Figure 6:
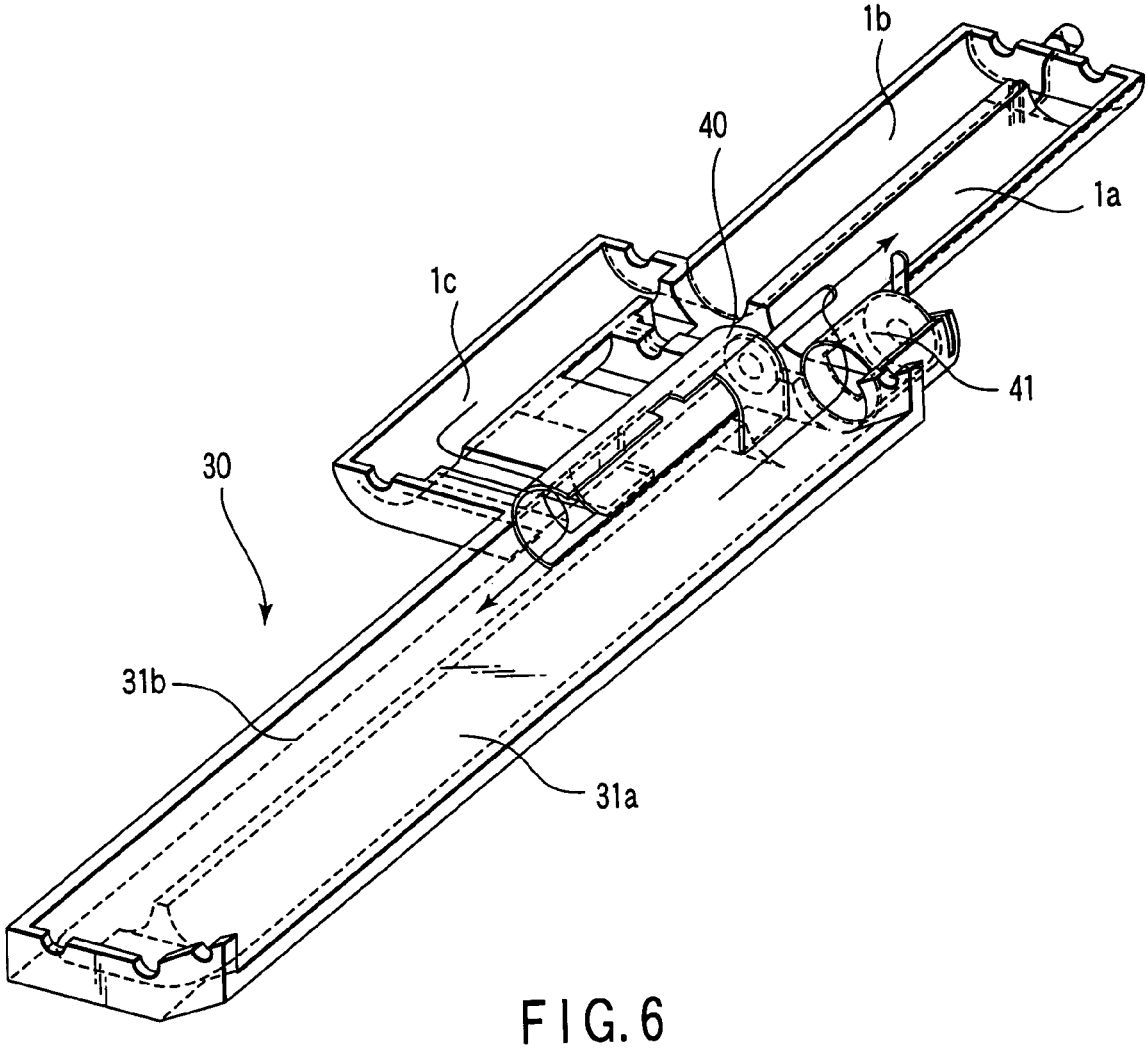
FIG. 6 is a view for explaining the shutter and the flow of developer.

FIG. 5 and FIG. 6 illustrate the shutters 40 and 41 and the flow of developer. For easier understanding, these Figures show only the casings of the first chambers 31*a*, 31*b* and second chambers 1*a*, 1*b* and 1*c*, and the shutters 40 and 41. The shutter 40 controls movement of developer between the first chambers 31*a*and 31*b* and between the second chamber 1*c* and the first chamber 31*b*. The shutter 41 controls movement of developer between the first chamber 31*a* and the second chamber 1*a*.

In the state shown in FIG. 5, the shutter 40 permits communication between the first chambers 31*a* and 31*b*, and prevents communication between the second chamber 1*c* and the first chamber 31*b*. The shutter 41 prevents communication between the first chamber 31*a* and the second chamber 1*a*. Accordingly, no movement of developer occurs between the first chambers 31*a*, 31*b* and the second chambers 1*a*, 1*b* and 1*c*. Movement of developer is permitted only between the first chambers 31*a* and 31*b*. In short, the developer circulates in the order of the first chamber 31*a*→31*b*→31*a*.

In the state shown in FIG. 6, the shutter 40 prevents communication between the first chambers 31*a* and 31*b*, and permits communication between the second chamber 1*c* and the first chamber 31*b*. The shutter 41 permits communication between the first chamber 31*a* and the second chamber 1*a*. Thus, as indicated by arrows in FIG. 6, the developer can move between the first chambers 31*a*, 31*b* and the second chambers 1*a*, 1*b*, 1*c*.

Figure 7:
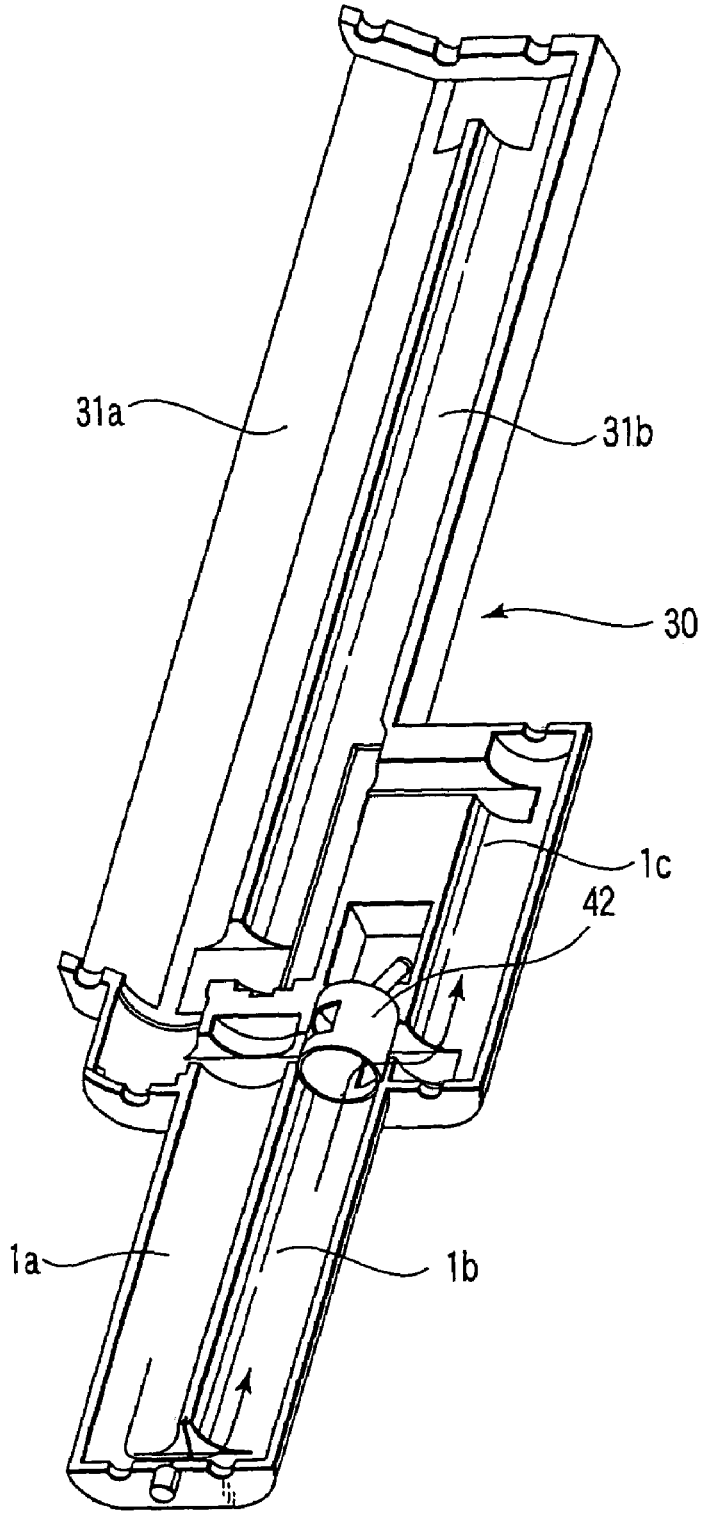
FIG. 7 is a view for explaining the shutter and the flow of developer.
Figure 8:
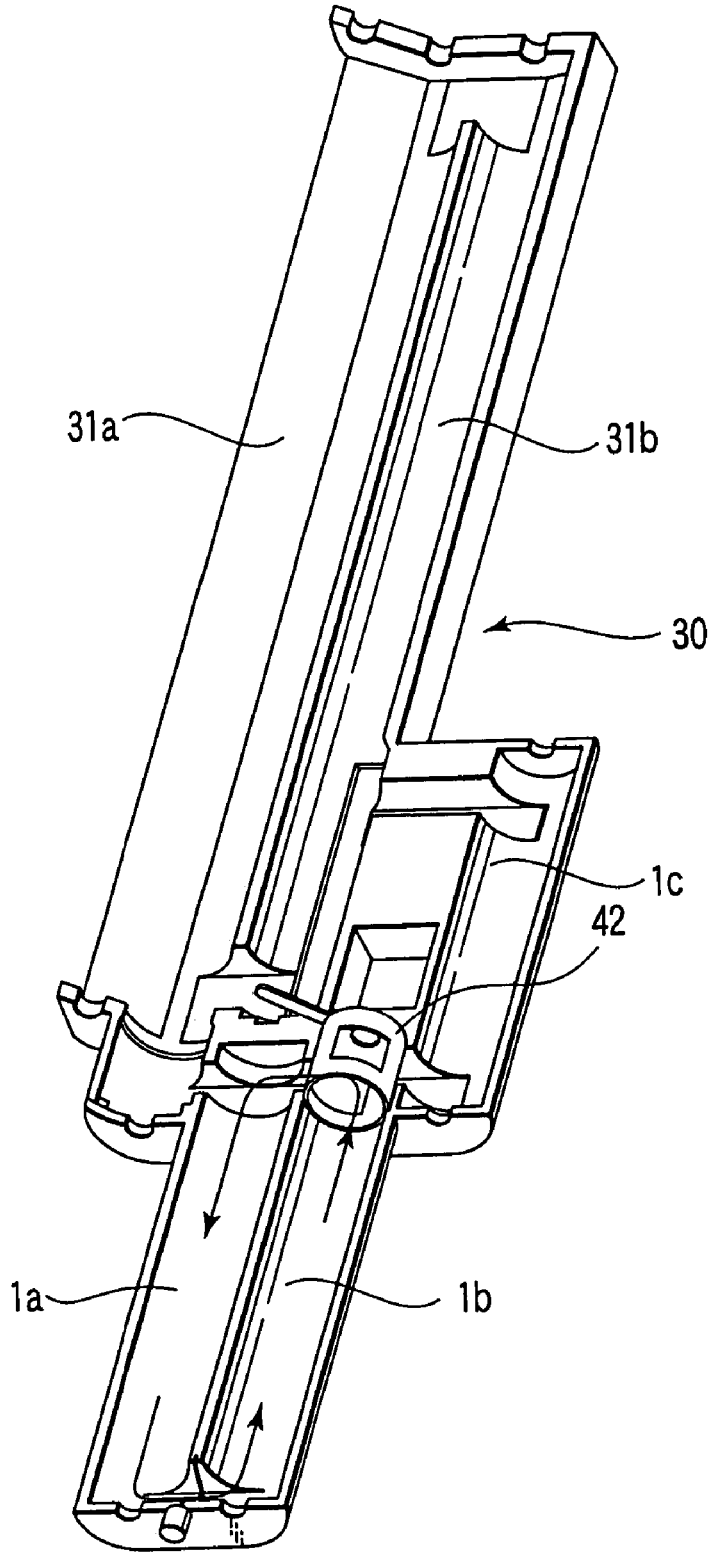
FIG. 8 is a view for explaining the shutter and the flow of developer.

FIG. 7 and FIG. 8 illustrate the shutter 42 and the flow of developer. For easier understanding, these Figures show only the casings of the first chambers 31*a*, 31*b* and the second chambers 1*a*, 1*b*, 1*c*, and the shutter 42. The shutter 42 controls movement of developer between the second chambers 1*b* and 1*c* and between the second chambers 1*a* and 1*b*.

In the state illustrated in FIG. 7, the shutter 42 prevents communication between the second chambers 1*a* and 1*b*. Accordingly, the developer moves in the order of the second chamber 1*a*→1*b*→1*c*.

In the state illustrated in FIG. 8, the shutter 42 prevents communication between the second chambers 1*b* and 1*c*. Accordingly, the developer circulates in the order of the second chamber 1*a*→1*b*→1*a*.

In the developing device 30, a developer for development is put in the first chambers 31*a* and 31*b*. Part of the developer, which is moved from the first chambers 31*a* and 31*b*, is put in the second chambers 1*a*, 1*b* and 1*c*.

As is shown in FIG. 4, in normal operation states including a recording mode, the shutters 40, 41 and 42 are set in the states shown in FIG. 5 and FIG. 7. Specifically, the developer in the first chambers 31*a* and 31*b* can circulate in the order of 31*a*→31*b*, and the developer in the second chambers 1*a*, 1*b* and 1*c* can move in the order of 1*a*→1*b*→1*c*.

The positions of the shutters 40 and 41 are changed only when the developer is moved between the first chambers 31*a*, 31*b* and the second chambers 1*a*, 1*b*, 1*c*. The developer is moved during the non-recording time.

Next, the movement operation of developer in the developing device 30 of the first embodiment is explained. The movement operation is controlled by the CPU 110 through the process control unit 116.

To start with, the positions of the shutters 40 and 41 of the developing device 30 are changed from the state shown in FIG. 5 to the state shown in FIG. 6. Thereby, the developer is made movable between the first chambers 31*a*, 31*b* and the second chambers 1*a*, 1*b*, 1*c*.

The motor 39 is driven to rotate the developing roller 34 and mixers 32 and 33 via the gears 35, 36, 37 and 38. The developer is stirred and conveyed for a predetermined time T.

At the same time, the motor 48 is driven to rotate the mixers 2 and 3 via the gears 44, 45, 46 and 47. The developer is stirred and conveyed for the predetermined time T.

At the same time, the motor 51 is driven to rotate the mixer 4 via the gears 49 and 50. The developer is stirred and conveyed for the predetermined time T.

Thereby, the developer is moved from the first chambers 31*a*, 31*b* to the second chambers 1*a*, 1*b*, 1*c*. When the movement is finished, the positions of the shutters 40 and 41 are changed to the state shown in FIGS. 5 and 7.

The amount of movement of developer is understandable from the rotational speed and shapes of the mixers 32 and 33. Hence, the amount of developer, which is moved from the first chamber 31*a* to the second chamber 1*a*, can be estimated in advance.

In this embodiment, about half the developer in the first chambers 31*a*, 31*b* is replaced.

In the embodiment, the replacement of developer is performed each time recording (copying) of 10,000 sheets is completed.

Next, an operation at a recording (copying operation) time is described referring to FIGS. 1, 2 and 4.

When a copy button (not shown) on the operation panel 6 is pressed, the CPU 110 causes the charging device 61 to charge the surface of the photoconductor body 60, and causes the exposure device 62 to expose the photoconductor body 60 in accordance with image data. Thus, an electrostatic latent image is formed on the photoconductor body 60. Subsequently, the CPU 110 develops the electrostatic latent image into a toner image, using toner on the developing roller 34 of the developing device 30.

Toner is conveyed to the developing roller 34 in the following manner. The motor 39 shown in FIG. 4 is driven to rotate the mixers 32 and 33. Thus, the developer in the first chambers 31*a* and 31*b* is circulated, stirred and conveyed to the developing roller 34. At this time, the developer in the second chambers 1*a*, 1*b*, 1*c* is neither stirred nor conveyed, and is held.

The CPU 110 instructs the transfer device 64 to electrostatically transfer the toner image on the photoconductor body 60 to paper (not shown). The toner image on the paper is fixed by heat and pressure in the fixing device 65. After the toner image is transferred from the photoconductor body 60 to the paper (not shown), the photoconductor body 60 is illuminated with light from the charge erase device 63 and the charge remaining on the photoconductor body 60 is erased.

As has been described above, according to the first embodiment, at the time of recording, part of the developer is held in the second chambers and is neither stirred nor conveyed. Therefore, degradation of developer that is held can be prevented.

The image forming apparatus of this invention is not equipped with a cleaning device for the photoconductor body 60, as shown in FIG. 1. If the cleaning mechanism is not provided, there is a fear of adverse effect due to toner on the photoconductor body 60, which remains after the transfer of the toner image to the paper. However, no problem arises with the toner, since the toner is recovered into the developing device 30 at the same time as the development.

When the toner is recovered into the developing device 30, however, paper dust of the paper sheet also enters the developing device 30. The paper dust, which has once entered the developing device 30, will never go out. In a short time period, there would be no problem. However, if paper dust accumulates in the developing device 30 over a long time, a development defect, such as non-formation of image, would occur.

In order to maintain good image formation over a long time, it is necessary to provide a means for reclaiming the developer, thereby removing paper dust and recycling the developer for use during a regular development time.

In the image forming apparatus of this invention, a filter is used as the means for reclaiming the developer. As is shown in FIG. 4, a filter 55 for removing paper dust is provided between the second chamber 1*a* and second chamber 1*b*. Since paper dust can be removed by the filter 55, good image formation can be maintained.

It is possible to dispose the filter in the first chamber having the developing roller. However, it is not preferable to dispose there such a filter or anything else that may become an obstacle to toner conveyance. If the filter is provided, the flow of toner would deteriorate and the speed of conveyance of toner to the developing roller would lower, leading to non-uniformity in image density.

In the present invention, the filter 55 is provided in the second chambers (between chambers 1*a* and 1*b*) that do not have the developing roller 34. Thus, even if the flow of toner becomes less smooth, there is no effect on images. If the filter 55 is completely clogged and the conveyance of toner is disabled, the filter 55 should be replaced.

Next, a second embodiment is described.

Figure 9:
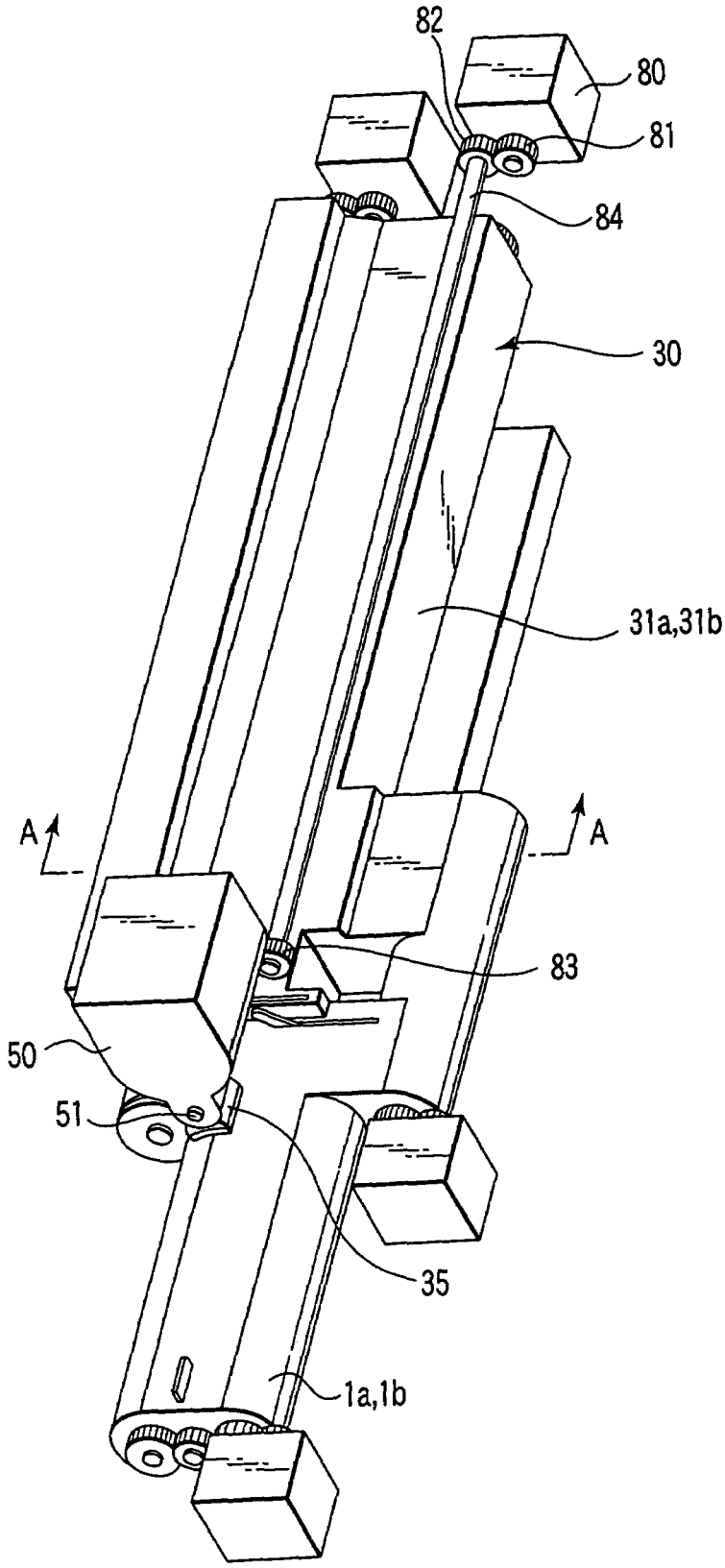
FIG. 9 schematically shows the structure of a developing device according to a second embodiment.

FIG. 9 schematically shows the structure of a developing device 30 according to the second embodiment. Like the first embodiment, the developing device 30 includes first chambers 31*a*, 31*b* and second chambers 1*a*, 1*b*, 1*c* for containing a developer. The developing device 30 of the second embodiment also includes an inlet 35 on the second chamber 1*a*, as shown in FIG. 9. A hopper 50 is disposed above the inlet 35.

The hopper 50 incorporates a mixer 51. The mixer 51 is rotated by a motor 80 via gears 81, 82 and 83 and a shaft 84.

Figure 10:
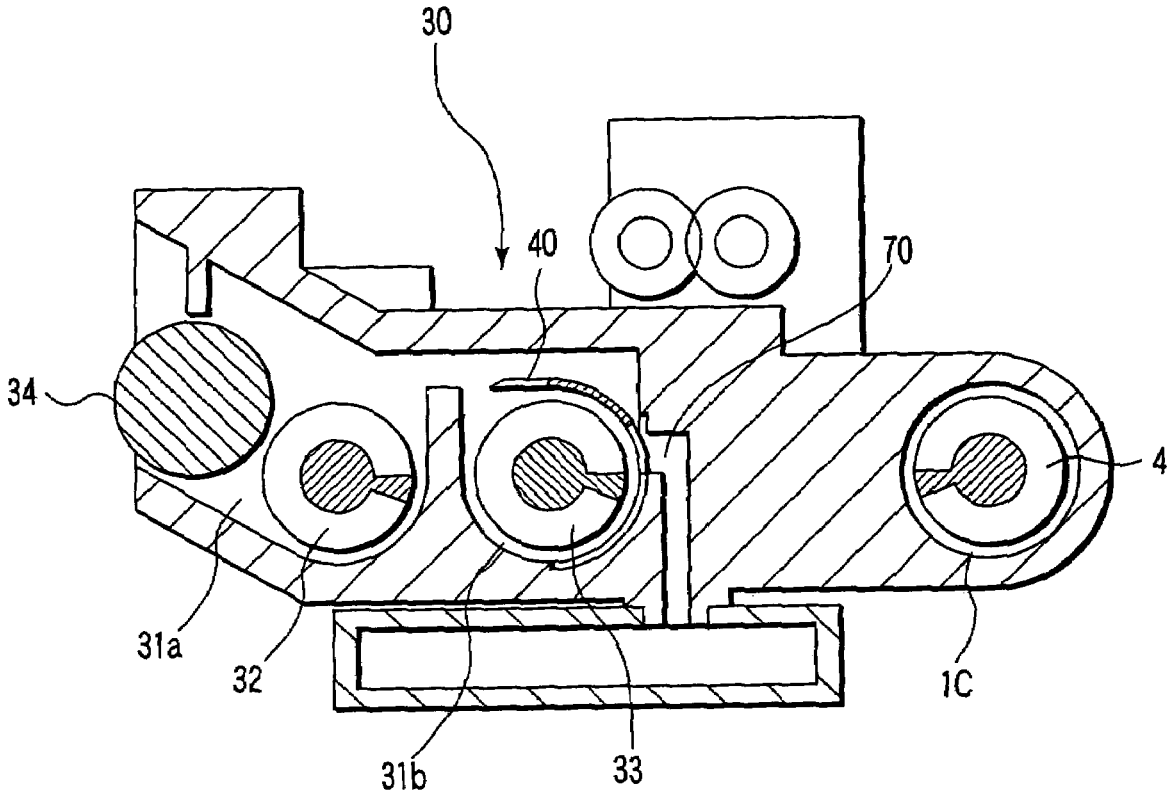
FIG. 10 shows a cross-sectional structure of the developing device.

FIG. 10 is a cross-sectional view taken along line A—A in FIG. 9. The structure of the developing device 30, taken through section A—A, comprises the second chamber 1*c*, first chambers 31*a* and 31*b*, mixers 4, 32 and 33, developing roller 34, shutter 40, and a discharge port 70. A supplemental description is given of the discharge port 70. As shown in FIG. 10, the shutter 40 is formed in such a shape as not to block the discharge port 70.

Figure 11:
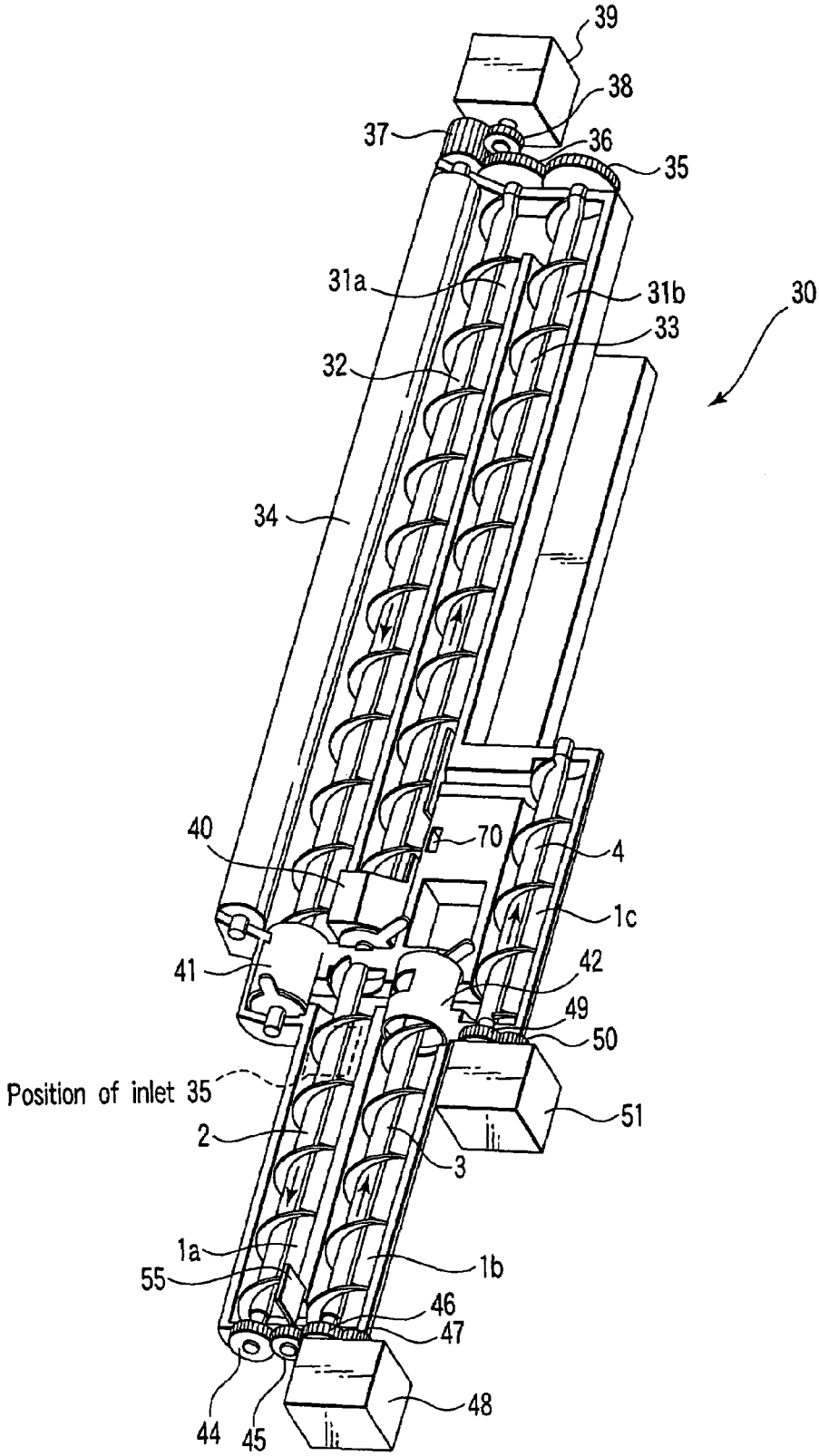
FIG. 11 is a perspective view of the developing device, with an upper part of the casing being removed to show the internal structure.

FIG. 11 is a perspective view of the developing device 30, with an upper part of the casing being removed to show the internal structure. The parts common to those in the first embodiment are denoted by like reference numerals, and a detailed description is omitted. Different points are as follows. The inlet 35 is provided in the second chamber 1*a* at a location indicated by a broken line, and the discharge port 70 is provided.

The operation at the recording time is the same as in the first embodiment, so a description is omitted here.

Next, a description is given of the stirring/movement distance after the replenishment of developer in the second embodiment. This operation is controlled by the CPU 110 through the process control unit 116.

In the developing device 30, a developer for development is put in the first chambers 31*a* and 31*b*. Part of the developer, which is moved from the first chambers 31*a* and 31*b*, is put in the second chambers 1*a*, 1*b* and 1*c*.

As is shown in FIG. 11, in normal operation states including a recording mode, the shutters 40, 41 and 42 are set in the states shown in FIG. 5 and FIG. 7. Specifically, the developer can circulate in the order of the first chamber 31*a*→31*b* and can move in the order of the second chamber 1*a*→1*b*43 1*c*. The positions of the shutters 40 and 41 are changed only when the developer is moved between the first chambers 31*a*, 31*b* and the second chambers 1*a*, 1*b*, 1*c*. The developer is moved while developer is replenished in the second chambers 1*a*, 1*b* and 1*c*.

Next, an operation at the time of developer replenishment is described.

To start with, the positions of the shutters 40 and 41 of the developing device 30 are changed from the state shown in FIG. 5 to the state shown in FIG. 6. Thereby, the developer is made movable between the first chambers 31*a*, 31*b* and the second chambers 1*a*, 1*b*, 1*c*.

The motor 39 is driven to rotate the developing roller 34 and mixers 32 and 33 via the gears 35, 36, 37 and 38. The developer is stirred and conveyed. At the same time, the motor 48 is driven to rotate the mixers 2 and 3 via the gears 44, 45, 46 and 47, and the motor 51 is driven to rotate the mixer 4 via the gears 49 and 50.

Similarly, the motor 80 is driven to rotate the mixer 51 via the gears 81, 82 and 83 and shaft 84, and new developer in the hopper 50 is replenished into the second chamber 1*a*. The new developer is mixed with the developer that comes from the first chamber 31*a*, and is stirred and conveyed within the second chambers 1*a*, 1*b* and 1*c* and fed into the first chamber 31*b*.

If the motor 80 is stopped, the replenishment of developer from the hopper 50 via the mixer 51 is stopped. After passage of a predetermined time T, the motors 39, 48 and 51 are stopped, and the stirring/conveyance of developer is also stopped. The positions of the shutters 40 and 41 of the developing device 30 are changed to the state shown in FIGS. 5 and 7.

With the above-described operation, the new developer is put (replenished) into the developing device 30, and the apparatus is set in the initial state in which the developer is put in the first chambers 31*a*, 31*b* and the second chambers 1*a*, 1*b* and 1*c*.

The volume of developer in the developing device 30 temporarily increases by an amount of replenished new developer. The amount of developer, which corresponds to the increase in volume, is let to overflow from the discharge port 70 and is discharged. Since the developer to be discharged is pushed out, new developer is not discharged.

As has been described above, according to the second embodiment, when the new developer is mixed with the developer in the developing device 30 and stirred, the distance for stirring (time for stirring) can be increased. Therefore, good mixing of developer is achieved and stable image formation of output images can be realized.

The distance between the developer replenishment position in the developing device 30, that is, the position of the inlet 35 above the second chamber 1*a*, and the discharge port 70 is made longer than in the case where developer is directly replenished into the first chamber 31*b*. Therefore, new developer is not discharged, and the ratio of replacement of developer increases.

Next, a description is given of an operation relating to preliminary stirring of replenishing developer at a non-recording time.

In the developing device 30, a developer for development is put in the first chambers 31*a*and 31*b*. Part of the developer, which is moved from the first chambers 31*a* and 31*b*, is put in the second chambers 1*a*, 1*b* and 1*c*.

As is shown in FIG. 11, in normal operation states including a recording mode, the shutters 40, 41 and 42 are set in the states shown in FIG. 5 and FIG. 7. Specifically, the developer can circulate in the order of the first chamber 31*a*→31*b* and can move in the order of the second chamber 1*a*→1*b*→1*c*.

In this state, the position of the shutter 42 is changed from that shown in FIG. 7 to that shown in FIG. 8. Communication between the second chambers 1*b* and 1*c* is blocked, and communication between the second chambers 1*b* and 1*a* is permitted. As a result, the developer in the second chambers 1*a* and 1*b* is made circulable in the order of 1*a*→1*b*→1*a*.

The motor 48 is driven to rotate the mixers 2 and 3 via the gears 44, 45, 46 and 47. Similarly, the motor 80 is driven to rotate the mixer 51 via the gears 81, 82 and 83 and shaft 84, and new developer is replenished into the second chambers 1*a* and 1*b*. The new developer is mixed with the developer that comes from the first chamber 31*a* and is held there. Until the developer is fully mixed, the developer is circulated and stirred within the second chambers 1*a* and 1*b*.

After passage of a predetermined time period, the motors 48 and 80 are stopped, and the replenishment of new developer and the stirring in the second chambers 1*a* and 1*b* are stopped. Then, the position of the shutter 42 is restored to state shown in FIG. 7. Thus, the preliminary stirring operation is completed.

Next, a description is given of an operation at a time of replenishing toner into the developing device 30. The above-described preliminarily stirred developer is replenished into the developing device 30.

To start with, the positions of the shutters 41 and 42 are changed from the state shown in FIG. 5 to the state shown in FIG. 6. Thereby, the developer is made movable between the first chambers 31*a*, 31*b* and the second chambers 1*a*, 1*b*, 1*c*.

The motor 39 is driven to rotate the developing roller 34 and mixers 32 and 33 via the gears 35, 36, 37 and 38, and the developer is stirred and conveyed. At the same time, the motor 48 is driven to rotate the mixers 2 and 3 via the gears 44, 45, 46 and 47, and the motor 51 is driven to rotate the mixer 4 via the gears 49 and 50.

As a result, the developer in the first chambers 31*a*, 31*b* is moved into the second chambers 1*a*, 1*b*, 1*c*, and the developer that is mixed with new developer is moved from the second chambers 1*a*, 1*b*, 1*c* into the first chambers 31*a*, 31*b*. After passage of a predetermined time T, the motors 39, 48 and 51 are stopped. The positions of the shutters 41 and 42 are changed to the state shown in FIGS. 5 and 7.

With the above-described operation, the new developer is put (replenished) into the developing device 30, and the apparatus is set in the initial state in which the developer is put in the first chambers 31*a*, 31*b* and the second chambers 1*a*, 1*b* and 1*c*.

The volume of developer in the developing device 30 temporarily increases by an amount of replenished new developer. The amount of developer, which corresponds to the increase in volume, is let to overflow from the discharge port 70 and is discharged. Since the developer to be discharged is pushed out, new developer is not discharged.

Similarly, the developer that comes into the second chambers 1*a*, 1*b* and 1*c* is pushed in, so no new developer is included. The developer replenishing operation is thus completed. A further preliminary stirring operation is executed in preparation for the next developer replenishment. The preliminary stirring operation is the same as described above.

As has been described above, according to the second embodiment, pre-stirred, well-mixed developer is fed into the developing device 30. Therefore, stable image formation can be performed.

Next, a third embodiment is described.

Figure 12:
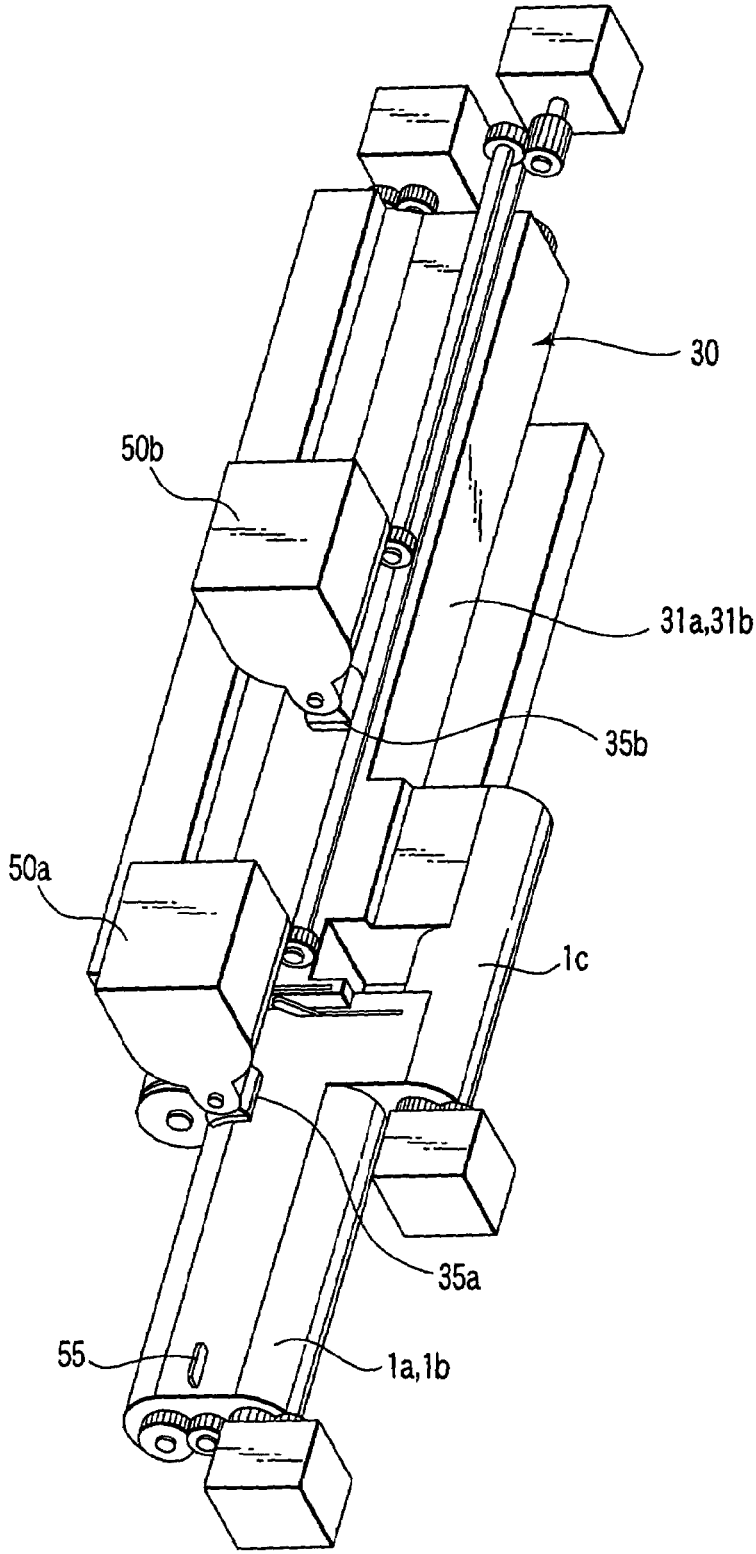
FIG. 12 schematically shows the structure of a developing device according to a third embodiment.

FIG. 12 schematically shows the structure of a developing device 30 according to the third embodiment. Like the first embodiment, the developing device 30 includes first chambers 31*a*, 31*b* and second chambers 1*a*, 1*b*, 1*c* for containing a developer. An inlet 35*b* is provided on the first chamber 31*b*, and a hopper 50*b* is disposed above the inlet 35*b*. An inlet 35*a* is provided on the second chamber 1*a*, and a hopper 50*a* is disposed above the inlet 35*a*.

Figure 13:
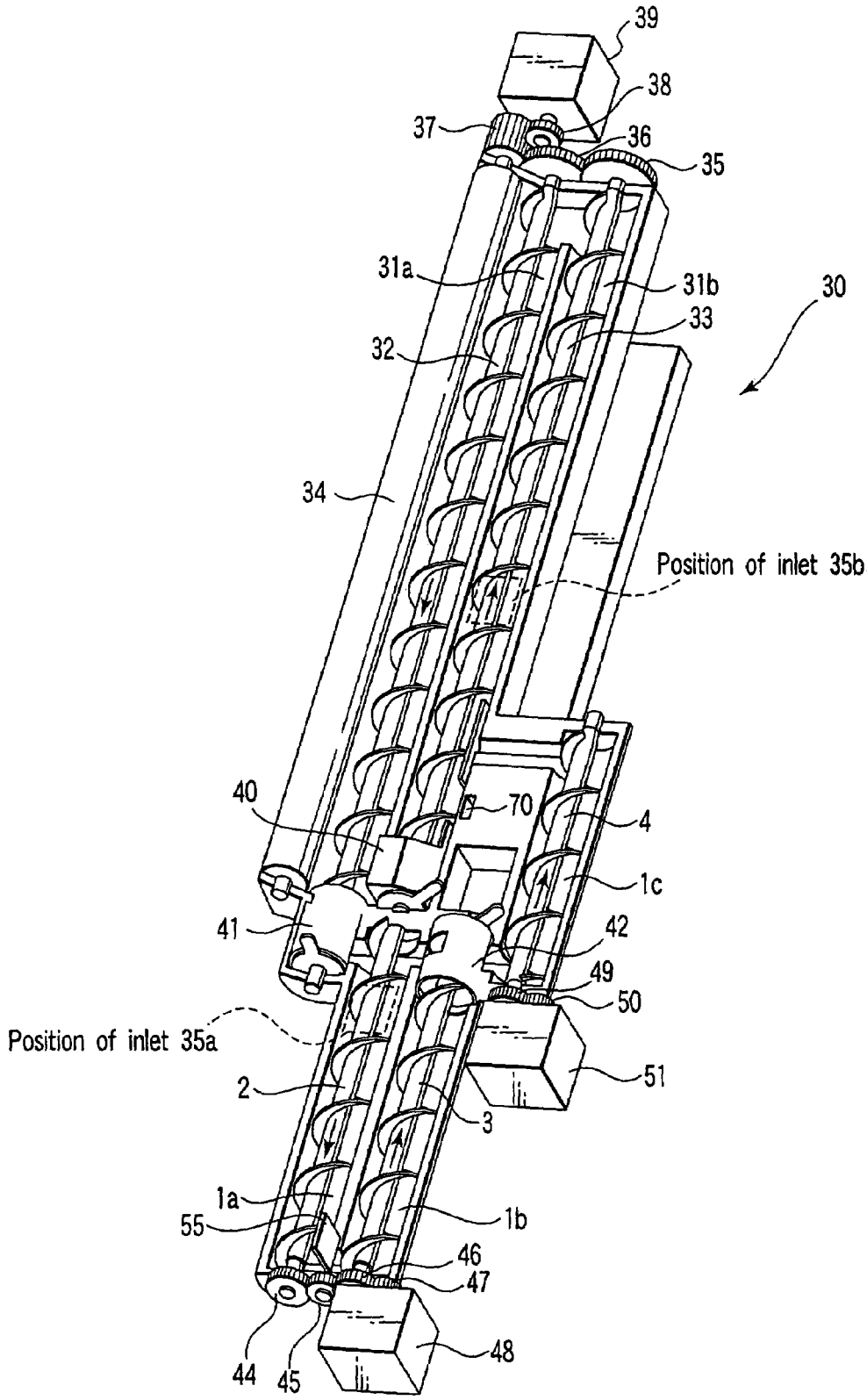
FIG. 13 is a perspective view of the developing device, with an upper part of the casing being removed to show the internal structure.

FIG. 13 is a perspective view of the developing device 30, with an upper part of the casing being removed to show the internal structure. The parts common to those in the first embodiment are denoted by like reference numerals, and a detailed description is omitted. Different points are as follows. The inlet 35*b* is provided in the first chamber 31*b* at a location indicated by a broken line, the inlet 35*a* is provided in the second chamber 1*a* at a location indicated by a broken line, and the discharge port 70 is provided.

As regards the method of developer replenishment, a small amount of developer is replenished into the developing device 30 while a recording operation is being performed. When a large amount of replenishing developer is needed in the case of forming, e.g. a solid image, the recording operation is halted and a large amount of developer is replenished and stirred. After the developer is fully stirred, the recording is executed.

In the present embodiment, the second chamber 1*a* for storing developer is used in addition to the first chamber 31*b*. Thereby, a small amount of developer is replenished into the developing device 30 while recording is being executed.

A developer replenishing method in this case is described.

During recording, a small amount of new developer is replenished from the hopper 50*b* through the inlet 35*b*, and the replenished developer is constantly stirred by the mixers 32 and 33. Since the amount of replenished new developer is small, the new developer can quickly be mixed with the developer in the first chambers 31*a* and 31*b* of the developing device 30.

Toner is consumed via the developing roller 34. If the amount of consumed toner is greater than the amount of toner contained in the replenished new developer, the amount of toner in the first chambers 31*a* and 31*b* decreases. When the toner becomes deficient, the developer in the second chambers 1*a*, 1*b*, 1*c* is fed into the first chambers 31*a* and 31*b*.

The developer that is fed from the second chambers 1*a*, 1*b*, 1*c* is the well-mixed developer (a description of the associated structure and operation is omitted since such structure and operation are the same as in the first and second embodiments). Since no problem arises if the developer is conveyed to the developing roller 34, there is no need to stir the developer in the developing device by halting the recording operation as in the prior art.

As has been described above, according to the third embodiment, the pre-stirred, well-mixed developer is fed from the second chambers 1*a*, 1*b*, 1*c* into the first chambers 31*a*, 31*b*. Therefore, stable image formation is realized.

Since the stirring is performed while the recording is not halted, smooth recording on paper can be executed even in a successive recording mode.

In the third embodiment, two hoppers (50*a*, 50*b*) are provided. Alternatively, a single hopper may be used such that developer is dividedly replenished into the first and second chambers. With this structure, too, the same advantageous effects can be obtained.

In the first and second embodiments, the same advantageous effects can be obtained if any one of the following configurations is adopted: a configuration in which the first and second chambers are integrated as one body; a configuration in which the first and second chambers are separate parts and are joined together; and a configuration in which the second chamber is disposed on the main body side of the copying machine and the first chamber, if attached to the main body of the copying machine, is joined to the second chamber.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus that forms an image using a two-component developer, comprising:

first storing means for storing the two-component developer;

first stirring/conveying means for stirring/conveying the two-component developer that is stored in the first storing means;

developing means for effecting development using the two-component developer that is stirred/conveyed by the first stirring/conveying means;

second storing means for storing the two-component developer;

second stirring/conveying means for stirring/conveying the two-component developer that is stored in the second storing means; and control means for controlling movement of the two-component developer that is stored in the first storing means and the second storing means, using the first and second stirring/conveying means, the control means inhibiting the two-component developer from moving in the development, and allowing the two-component developer to move at a predetermined timing.

2. The image forming apparatus according to claim 1, wherein the control means executes a control to move part of the two-component developer, which is stored in the first storing means, into the second storing means and to hold the part of the two-component developer.

3. The image forming apparatus according to claim 1, wherein the control means executes a control to move part of the two-component developer, which is stored in the first storing means, into the second storing means and to hold the part of the two-component developer, and executes a control to move the part of the two-component developer, which is held in the second storing means, into the first storing means.

4. The image forming apparatus according to claim 1, wherein the second storing means includes reclaiming means for reclaiming the two-component developer.

5. The image forming apparatus according to claim 4, wherein the reclaiming means is means for removing paper dust that is contained in the two-component developer.

6. An image forming apparatus that forms an image using a two-component developer, comprising:

first storing means for storing the two-component developer;

first stirring/conveying means for stirring/conveying the two-component developer that is stored in the first storing means;

developing means for effecting development using the two-component developer that is stirred/conveyed by the first stirring/conveying means;

second storing means for storing the two-component developer;

supply means for supplying a replenishing two-component developer into the second storing means;

second stirring/conveying means for stirring/conveying the two-component developer that is stored in the second storing means; and control means for controlling movement of the two-component developer that is stored in the first storing means and the second storing means, using the first and second stirring/conveying means, the control means inhibiting the two-component developer from moving in the development, and allowing the two-component developer to move at a predetermined timing, and controlling supply of the replenishing two-component developer by the supply means.

7. The image forming apparatus according to claim 6, wherein the control means executes a control to move the two-component developer, which is stored in the first storing means, into the second storing means, to supply, from the supply means, the replenishing two-component developer to the two-component developer that is moved into the second storing means, and to stir/convey the conveyed two-component developer and the replenishing two-component developer using the second stirring/conveying means, thereby moving the conveyed two-component developer and the replenishing two-component developer into the first storing means.

8. The image forming apparatus according to claim 6, wherein the first storing means includes discharge means for discharging the two-component developer by causing the two-component developer to overflow.

9. The image forming apparatus according to claim 6, wherein the control means executes a control to move part of the two-component developer, which is stored in the first storing means, into the second storing means, to supply, from the supply means, the replenishing two-component developer to the two-component developer that is moved into the second storing means, and to stir and hold the conveyed two-component developer and the replenishing two-component developer.

10. The image forming apparatus according to claim 6, wherein the control means executes a control to move part of the two-component developer, which is stored in the first storing means, into the second storing means, to supply, from the supply means, the replenishing two-component developer to the two-component developer that is moved into the second storing means, to stir and hold the conveyed two-component developer and the replenishing two-component developer, and to move the held two-component developer into the first storing means.

11. An image forming apparatus that forms an image using a two-component developer, comprising:

first storing means for storing the two-component developer;

first supply means for supplying a replenishing two-component developer into the first storing means;

first stirring/conveying means for stirring/conveying the two-component developer that is stored in the first storing means;

developing means for effecting development using the two-component developer that is stirred/conveyed by the first stirring/conveying means;

second storing means for storing the two-component developer;

second supply means for supplying a replenishing two-component developer into the second storing means;

second stirring/conveying means for stirring/conveying the two-component developer that is stored in the second storing means; and control means for controlling movement of the two-component developer that is stored in the first storing means and the second storing means, using the first and second stirring/conveying means, and controlling supply of the replenishing two-component developer by the first and second supply means.

12. The image forming apparatus according to claim 11, wherein the control means executes, at a time of image formation, a control to supply, from the first supply means, the replenishing two-component developer into the first storing means, and executes, at a non-image-formation time, a control to move part of the two-component developer, which is stored in the first storing means, into the second storing means, to supply, from the supply means, the replenishing two-component developer to the two-component developer that is moved into the second storing means, to stir and hold the conveyed two-component developer and the replenishing two-component developer, and to move, at a time of image formation, the held two-component developer into the first storing means.

13. An image forming apparatus that forms an image using a two-component developer, comprising:

a first chamber that stores the two-component developer;

a first mixer that stirs/conveys the two-component developer that is stored in the first chamber;

a developing device that effects development using the two-component developer that is stirred/conveyed by the first mixer;

a second chamber that stores the two-component developer;

a second mixer that stirs/conveys the two-component developer that is stored in the second chamber; and a control unit that controls movement of the two-component developer that is stored in the first chamber and the second chamber, using the first and second mixers, the control unit inhibiting the two-component developer from moving in the development, and allowing the two-component developer to move at a predetermined timing.

14. An image forming apparatus that forms an image using a two-component developer, comprising:

a first chamber that stores the two-component developer;

a first mixer that stirs/conveys the two-component developer that is stored in the first chamber;

a developing device that effects development using the two-component developer that is stirred/conveyed by the first mixer;

a second chamber that stores the two-component developer;

a hopper that supplies a replenishing two-component developer into the second chamber;

a second mixer that stirs/conveys the two-component developer that is stored in the second chamber; and a control unit that controls movement of the two-component developer that is stored in the first chamber and the second chamber, using the first and second mixers, the control unit inhibiting the two-component developer from moving in the development, and allowing the two-component developer to move at a predetermined timing, and controls supply of the replenishing two-component developer by the hopper.

15. An image forming apparatus that forms an image using a two-component developer, comprising:

a first chamber that stores the two-component developer;

a first hopper that supplies a replenishing two-component developer into the first chamber;

a first mixer that stirs/conveys the two-component developer that is stored in the first chamber;

a developing device that effects development using the two-component developer that is stirred/conveyed by the first mixer;

a second chamber that stores the two-component developer;

a second hopper that supplies a replenishing two-component developer into the second chamber;

a second mixer that stirs/conveys the two-component developer that is stored in the second chamber; and a control unit that controls movement of the two-component developer that is stored in the first chamber and the second chamber, using the first and second mixers, and controls supply of the replenishing two-component developer by the first and second hoppers.

16. A method for controlling a developing device of an image forming apparatus that forms an image using a two-component developer, the developing device including:

a first chamber that stores the two-component developer;

a first mixer that stirs/conveys the two-component developer that is stored in the first chamber;

a developing roller that effects development using the two-component developer that is stirred/conveyed by the first mixer; a second chamber that stores the two-component developer; and a second mixer that stirs/conveys the two-component developer that is stored in the second chamber, the method comprising:

controlling movement of the two-component developer that is stored in the first chamber and the second chamber, using the first and second mixers, inhibiting the movement of the two-component developer in the development, and allowing the movement of the two-component developer at a predetermined timing.

17. A method for controlling a developing device of an image forming apparatus that forms an image using a two-component developer, the developing device including:

a first chamber that stores the two-component developer;

a first mixer that stirs/conveys the two-component developer that is stored in the first chamber;

a developing roller that effects development using the two-component developer that is stirred/conveyed by the first mixer;

a second chamber that stores the two-component developer;

a hopper that supplies a replenishing two-component developer into the second chamber; and a second mixer that stirs/conveys the two-component developer that is stored in the second chamber, the method comprising:

controlling movement of the two-component developer that is stored in the first chamber and the second chamber, using the first and second mixers, inhibiting the movement of the two-component developer in the development, allowing the movement of the two-component developer at a predetermined timing, and supplying of the replenishing two-component developer by the hopper.

18. A method for controlling a developing device of an image forming apparatus that forms an image using a two-component developer, the developing device including:

a first chamber that stores the two-component developer;

a first hopper that supplies a replenishing two-component developer into the first chamber;

a first mixer that stirs/conveys the two-component developer that is stored in the first chamber;

a developing roller that effects development using the two-component developer that is stirred/conveyed by the first mixer;

a second chamber that stores the two-component developer;

a second hopper that supplies a replenishing two-component developer into the second chamber; and a second mixer that stirs/conveys the two-component developer that is stored in the second chamber, the method comprising:

controlling movement of the two-component developer that is stored in the first chamber and the second chamber, using the first and second mixers, inhibiting the movement of the two-component developer in the development, allowing the movement of the two component developer at a predetermined timing, and supplying of the replenishing two-component developer by the first and second hoppers.

* * * * *